US010214705B2

(12) United States Patent
Hruschka et al.

(10) Patent No.: US 10,214,705 B2
(45) Date of Patent: Feb. 26, 2019

(54) METHOD AND DEVICE FOR PROCESSING AN ORGANIC OIL IN STEPS

(71) Applicant: GEA Westfalia Separator Group GmbH, Oelde (DE)

(72) Inventors: Steffen Hruschka, Oelde (DE); Wladislawa Boszulak, Oelde (DE)

(73) Assignee: GEA Westfalia Separator Group GmbH, Oelde (DE)

( * ) Notice: Subject to any disclaimer, the term of this patent is extended or adjusted under 35 U.S.C. 154(b) by 0 days.

(21) Appl. No.: 15/315,897

(22) PCT Filed: Jun. 3, 2015

(86) PCT No.: PCT/EP2015/062434
§ 371 (c)(1),
(2) Date: Dec. 2, 2016

(87) PCT Pub. No.: WO2015/185657
PCT Pub. Date: Dec. 10, 2015

(65) Prior Publication Data

US 2017/0107449 A1 Apr. 20, 2017

(30) Foreign Application Priority Data

Jun. 5, 2014 (DE) ..... 10 2014 107 976

(51) Int. Cl.
*C11B 3/00* (2006.01)
*C11B 3/04* (2006.01)
(Continued)

(52) U.S. Cl.
CPC ..... *C11B 3/001* (2013.01); *C11B 3/006* (2013.01); *C11B 3/04* (2013.01); *C11B 3/06* (2013.01); *C11B 3/10* (2013.01)

(58) Field of Classification Search
CPC ..... C11B 3/001
(Continued)

(56) References Cited

U.S. PATENT DOCUMENTS 2,752,378 A * 6/1956 Julian ..... C11B 3/06 552/545
4,160,774 A 7/1979 Shenoy et al.
(Continued)

FOREIGN PATENT DOCUMENTS

CN 103396884 A * 11/2013
JP 54-120609 A 9/1979

OTHER PUBLICATIONS

International Search Report (PCT/ISA/210) issued in PCT Application No. PCT/EP2015/062434 dated Sep. 8, 2015, with English translation (six (6) pages).

*Primary Examiner* — Deborah D Carr
(74) *Attorney, Agent, or Firm* — Crowell & Moring LLP

(57) ABSTRACT

A method is provided for processing an organic oil in steps, including the following: A) providing a raw oil; B) degumming the raw oil by adding water or acid to the raw oil and forming at least two phases, an aqueous phase and an oil phase, and separating the aqueous phase enriched in phospholipid from the oil phase; C) adding sodium hydrogencarbonate and/or sodium acetate to the oil phase from step B, and removing alkaline-earth compounds and/or phospholipids and/or stearyl glycosides, in solution or suspension in an aqueous phase, from the oil phase.

17 Claims, 5 Drawing Sheets

(51) Int. Cl.
*C11B 3/06* (2006.01)
*C11B 3/10* (2006.01)

(58) Field of Classification Search
USPC ..... 554/176
See application file for complete search history.

(56) References Cited

U.S. PATENT DOCUMENTS 4,808,426 A * 2/1989 Strop ..... C11B 1/00
426/417
6,197,357 B1 3/2001 Lawton et al.

* cited by examiner

METHOD AND DEVICE FOR PROCESSING AN ORGANIC OIL IN STEPS

FIELD OF THE INVENTION

The present invention relates to a method and apparatus for the stepwise processing of an organic oil.

BACKGROUND AND SUMMARY OF THE INVENTION

An organic oil contains lipid constituents and various other concomitants, with the latter lowering the quality of products of value that are obtained from the oil, and possibly limiting the use thereof.

In accordance with the prior art, with the aim of technical refining, oils are subjected usually to a process known as degumming, in order to transfer hydratable compounds into a water phase, thus allowing the dissolved or aggregated compounds to be removed by methods for phase separation. By means of these methods, the major fraction of hydratable phospholipids, and a fraction of non-hydratable phospholipids, are removed.

This is followed by removal of remaining phospholipids and of free fatty acids as concomitants from the oil fraction. This removal may involve subjecting the free fatty acids to hydrolysis, for example. In the vegetable oil there may typically be magnesium salts and/or calcium salts and/or chelates such as chlorophyll, for example, in solution in the vegetable oil. These compounds, however, are difficult to separate from the free fatty acids, and therefore, following the removal of the free fatty acids, dissolved or undissolved alkaline earth metal salts may be present as concomitants in the free fatty acids fraction.

It is therefore an object of the present invention to provide a method for the stepwise processing of an organic oil in order to attain a low fraction of dissolved and/or undissolved alkaline earth metal compounds and/or phospholipids and/or sterylglycosides.

This object is achieved in accordance with the embodiments of the invention.

A method according to the invention relates to the stepwise processing of an oil. This stepwise processing may preferably be integrated into an established refining operation for producing an edible oil or a fuel for internal-combustion engines, as a step sequence.

The stepwise processing comprises the following steps:

A Providing a Raw Oil

The raw oil may be obtained, for example, through from plants by pressing or extraction methods. However, diverse alternative provision variants are contemplated. The raw oil here need not necessarily have been obtained directly from living entities, but may also, as in the case of frying oil, have already been used for its intended purpose one or more times.

B Degumming the Raw Oil by Adding Water and/or Acid to the Raw Oil and Forming at Least Two Phases, an Aqueous Phase and an Oil Phase, and Separating the Phospholipid-Enriched Aqueous Phase from the Oil Phase Degumming per se is a conventional method step. A distinction is made between aqueous degumming and the more rarely employed acid degumming. The latter is preferred in the case of the methods of the invention. In one preferred variant embodiment, the addition of acid may comprise the addition of a dilute acid or, likewise preferably, the addition of a concentrated acid in conjunction with a subsequent addition of water. In this operation, primarily hydratable gums, such as hydratable phosphoglycerides, for example, such as phophatidylinositols and phosphatidylcholines, are separated from the oil phase and transferred into the aqueous phase. They can be removed centrifugally.

C Adding Sodium Hydrogencarbonate or Sodium Acetate to the Oil Phase, and Removing Alkaline Earth Metal Compounds and/or Phospholipids and/or Sterylglycerides, in Solution in an Aqueous Phase, from the Oil Phase The addition of sodium hydrogencarbonate results in removal of alkaline earth metal compounds and/or iron compounds, thus including chlorophyll, other magnesium complexes or else calcium complexes or iron complexes, for example. The removal of iron ions or iron compounds in particular makes the oil phase less susceptible to oxidation. In some cases the alkaline earth metal compounds may take the form of phospholipids. It is particularly noteworthy that as a result of the addition of sodium hydrogencarbonate, there is also removal of non-hydratable phospholipids, preferably non-hydratable phosphoglycerides, such as phosphatidylethanolamines, for example, and even of phosphatidic acid and salts thereof, especially the alkali metal and alkaline earth metal salts thereof. This is surprising since phosphatidic acid and salts of phosphatidic acid, which are usually present in the solution in an oil fraction, are very difficult to remove from the oil phase. The fact that this can now be accomplished in such a way that the free fatty acids remain predominantly in the oil phase and can be removed as a separate fraction. Removal may be accomplished preferably by phase separation of an aqueous phase and an oil phase in a centrifugal field.

The addition of sodium acetate results in removal of sterylglycosides. This class of substance can be detected by means of thin-layer chromatography (TLC). It has emerged here that the sterylglycoside-enriched aqueous phase contains only very small fractions of other organic constituents, such as phospholipids or free fatty acids, for example.

The product after step C is an organic oil which, relative to the degummed oil fraction in step B, has a lower fraction of one or more oil concomitants (sterylglycosides, alkaline earth metal compounds and/or phospholipids) which can usually be obtained only in a form poorly separated from the free fatty acids from an organic oil. The amount of free fatty acid relative to the oil fraction from step B is surprisingly almost unchanged after step C.

Further advantageous embodiments of the invention are apparent from the dependent claims, the description, the figures, and the examples.

The free fatty acids can advantageously now be obtained by hydrolysis in a form separated from the sterylglycosides and also, as and when required, separated from the phospholipids and/or other alkaline earth metal compounds. This hydrolysis takes place in a further optional step D Adding an Alkaline Agent to the Oil Fraction in Step C and with Removal of the Hydrolyzed Fatty Acids from the Aforesaid Oil Phase.

The removal may take place preferably as already occurred in step C, by phase separation of an aqueous phase and an oil phase in a centrifugal field.

In a further step, there may be further refining of the oil phase in step C or D as well. This is accomplished by the optional step of E Bleaching and/or Deodorizing the Oil Phase.

Since beforehand in step C even difficult-to-remove phospholipids have been removed to a large extent from the oil phase, and since optionally even free fatty acids have been removed from the phospholipid phase, the bleaching operation can be significantly more effective. Bleaching can be accomplished particularly effectively by means of bleaching earth, for example.

Deodorizing may likewise be configured effectively. As is known, deodorizing may be accomplished mechanically by means, for example, of steam distillation in a so-called deodorizer.

Elucidated in more detail below are further advantageous embodiments of individual method steps:

It is advantageous for degumming to take place by addition of an acid selected from one or more of the following acids: citric acid, acetic acid, formic acid, oxalic acid, hydrochloric acid, sulfuric acid, nitric acid and/or phosphoric acid. Among the aforementioned acids, particular suitability for the removal of gums has been shown by the organic acids.

Particularly for the class of the phosphoglycerides, as a subclass of the phospholipids, one of the views expressed in the case of triglycerides is that, starting from the $(R'CH_2)$—$(R''CH)$—$(R'''CH_2)$ scaffold structure, the respective long-chain substitutes R', R'', and R''' converge at elevated temperatures, meaning that hydration and hence the transition to a water phase and the removal of these substances are made more difficult. At the same time, however, there is also an increase in the viscosity of the oils in question.

It has emerged that the degumming of an oil according to step B and also the addition of sodium acetate and/or sodium hydrogencarbonate according to step C are possible at a temperature of more than 65° C. in spite of the aforesaid difficulties, with the degumming at a temperature in the range of 66-95° C. constituting a particularly good compromise between the two aforementioned effects.

Customarily, moreover, the expectation with the addition of sodium hydrogencarbonate in the form of an aqueous solution is that it would lead to more effective separation of the concomitants present in the oil phase, since the solution already contains hydrated cations and anions. It has emerged, however, that even the addition of sodium hydrogencarbonate and/or sodium acetate in the form of powder or in the form of suspension to the oil phase in step C added, and optionally a subsequent addition of one, compared to a solution, leads to a comparably good and selective outcome in the deposition of concomitants from the oil phase. At the same time, however, substantially less of a water phase requiring work-up is produced. The addition of water takes place advantageously before or after the addition of the powder.

Particularly good outcomes have been achieved on addition of more than 0.1 wt % of sodium hydrogencarbonate and/or sodium acetate, based on the total weight of the oil phase in step C.

It has emerged, moreover, that on addition of at least 1.0 wt % of water, based on the total weight of the oil phase in step C, very good removal of concomitants is achieved.

The addition of sodium hydrogencarbonate according to step C may be repeated until the haze of the water phase and/or an alkaline earth metal ion content found in the oil phase and/or a phosphorus content found in the oil phase falls below a specified setpoint value. A specific result of making the addition in the form of a powder or suspension, and adding comparatively little water, is that no extensive water phase requiring work-up is produced. As a result, step C can be carried out repeatedly without the processing becoming uneconomic because of solvents obtained. At the same time, the multiple addition achieves quantitatively improved removal of concomitants.

Following the addition of sodium hydrogencarbonate in step C, it is possible with preference to remove an aqueous phase containing a free fatty acid fraction corresponding to removal of less than 1% age point of free fatty acids from the oil phase. The reporting of percentage points is based on the decrease in the total amount of free fatty acids in the oil phase. It has emerged that on addition of sodium hydrogen, irrespective of the total amount of free fatty acids in the oil, it is possible to transfer consistently less than 1 percentage point into the water phase, whereas, for example, phospholipids, chlorophyll or other alkaline earth metal compounds are transferred in large portions into the aqueous phase.

In one preferred version, after the addition of sodium hydrogencarbonate in step C, an aqueous phase can be removed which comprises a fraction of free fatty acids corresponding to removal of less than 0.2% age points of free fatty acids from the oil phase.

This comparatively high degree of purity is achievable, but can also be smaller through reduced metering, according to the interest of the user.

Through the addition of sodium acetate in step C, it is possible with preference to achieve removal of an aqueous phase in which organic constituents are present, in solution or suspension, which contain more than 30 wt %, preferably more than 50 wt %, of sterylglycosides.

Following step C, it is possible with preference, in a step D, to perform hydrolysis of free fatty acids with addition of an alkaline agent to the oil phase from step C, thereby making it possible for these hydrolyzed fatty acids to be removed from the oil phase. The hydrolyzed fatty acids here may be transferred, as a relatively pure fraction from the oil phase, into an aqueous phase, which is formed by addition of water before, during or after the addition of the alkaline agent.

The hydrolyzed fatty acid may have preferably less than 3 wt %, preferably less than 1 wt %, of organic impurities. These soaps may be subsequently cleaved back to free fatty acids under pressure or with addition of acid. This reaction is commonly known as soap cleaving. In view of the relatively high purity of the soap fraction, the water phase obtained in the soap cleaving is not very contaminated. Contaminated soap fractions, on the other hand, would make soap cleaving more difficult.

Following step C or D, the oil phase from step C or D can be bleached and/or deodorized. This removes unwanted colorants and removes unwanted odorants and flavors from the oil phase. These are usually concluding steps in the refining of an oil for production of edible oils or fuels.

The added alkaline agent in step D may preferably be an inorganic alkali metal hydroxide solution, preferably a sodium hydroxide solution. The addition of this comparatively inexpensive agent is sufficient, following removal of sterylglycosides and/or phospholipids and/or alkaline earth metal compounds, to give an oil phase which is predominantly free from concomitants.

Provided in accordance with the invention, furthermore, is an apparatus configured to perform a method according to the invention.

BRIEF DESCRIPTION OF THE DRAWINGS

The subject matter of the invention is elucidated in more detail below with assistance from figures. They show the following.

BRIEF DESCRIPTION OF THE PREFERRED EMBODIMENTS

Figure 1:
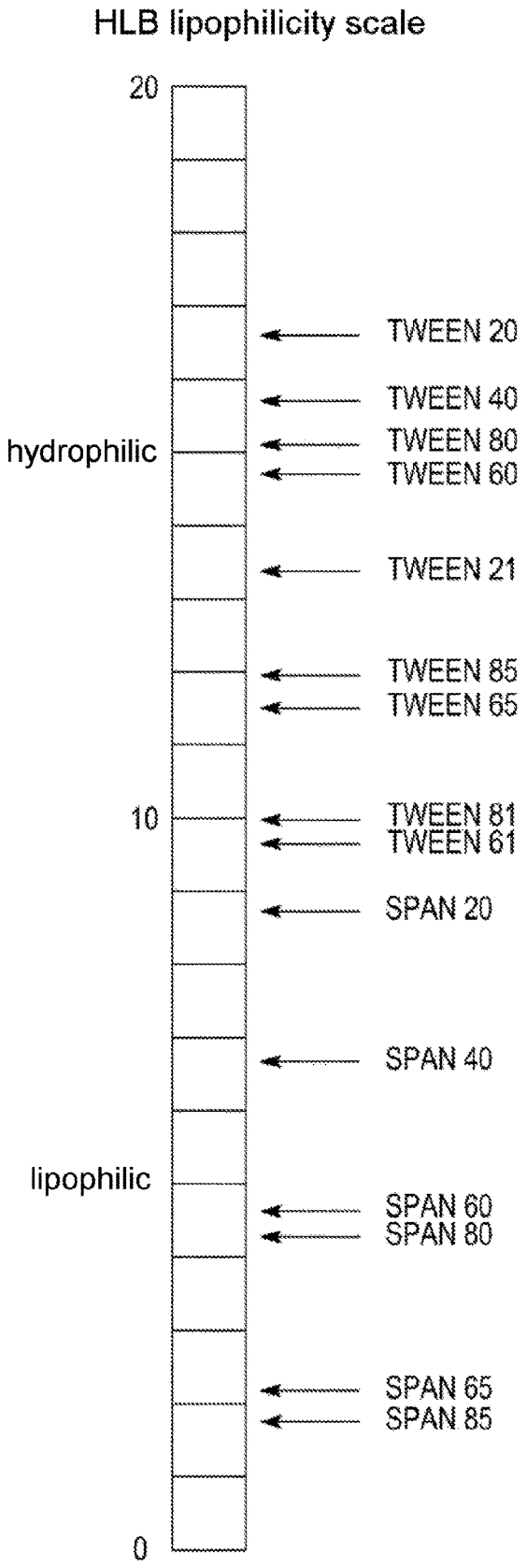
FIG. 1: shows the HLB lipophilicity scale, with the lipophilicity rising in the range from 10 to 0 and the hydrophilicity rising in the range from 10 to 20, and the substances around 10 being equally lipophilic and hydrophilic, i.e., they are equi-amphiphilic. The HLB lipophilicity scale value is reported for various TWEEN and SPAN emulsifiers as examples.
Figure 2:
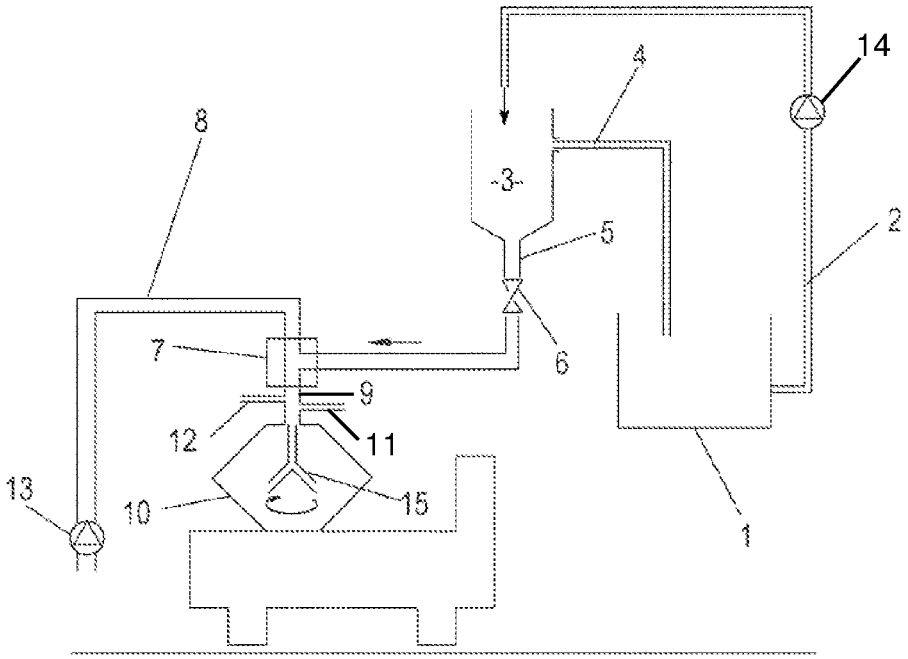
FIG. 2: shows apparatus of the invention for performing the methods described herein. 1 denotes a receptacle for receiving the aqueous phase comprising the aforementioned salts, 2 stands for a service, 3 for a container, 4 stands for an overflow return, 5 is a drain line, 6 is a valve, 7 a mixer, 8 a feed line, 9 drain line, 10 a centrifuge, 11 and 12 are two drains from the centrifuge, 13 a pump, 14 another pump, and 15 a distributor.

FIG. 2 shows apparatus of the invention including a receptacle 1 for receiving the aqueous phase and/or the salt solution or a suspension of the salts described herein. From the receptacle 1, a line 2 (into which, here, a pump 14 is inserted) leads to a container 3. This container 3 is designed preferably as a constant-pressure buffer container. For this purpose, the container 3 may have an overflow return 4 which serves to pass liquid back from the container 2 into the receptacle 1 if an overflow level is exceeded.

The container 3, moreover, has a drain line 5 (preferably at its bottom end), into which here a valve 6 is inserted. The valve 6 can be used to control the volume of flow in the drain line 5. The drain line opens into a mixer 7. Also leading into the mixer 7 is a feed line 8, into which a pump 13 may be inserted. Through the feed line 8 it is possible to pass a further phase, preferably the lipoid-containing (lipid) phase, into the mixer 7. The mixer 7, moreover, has a drain line 9 which opens into an intake of a centrifuge 10. In the mixer 7, the two phases supplied are mixed.

In the centrifuge 10, there is centrifugal separation into two phases with different densities, these phases flowing off from the centrifuge through two drains 11 and 12. There are a variety of ways in which the mixer 7 can be designed. For instance, a static mixer or a dynamic mixer may be used. Specialist forms are also suitable, such as a high-shear mixer or a nanoreactor. It is likewise conceivable for the centrifuge itself to be used as a mixer. In that case, the lipoid phase and the salt solution (aqueous solution) are passed through separate feed lines into the centrifuge, where—in a distributor 15 of the centrifuge drum, for example—the two phases are mixed. Distributors of this kind are known per se and are used to transfer the incoming product into the rotating drum.

The centrifuge used is preferably a separator with a vertical axis of rotation, designed to separate two liquid phases having different densities.

The apparatus can also be designed for operation under a pressure p which is higher than atmospheric pressure. The following is preferably the case: 1 bar≤p<10 bar. The drain pressure in the drains 11 and 12 ought to be higher than the intake pressure in the feed line to the centrifuge. Introduction of air in the intake is preferably to be avoided, in order to prevent an emulsion forming to a disruptive extent in the mixer and/or in the centrifuge drum.

It has been possible to show that with this apparatus, emulsification can be avoided, with the consequence firstly that fractions to be separated and containing phospholipids, alkaline earth metal-containing compounds and/or sterylglycosides can be removed more effectively, since phase separation is better, and secondly the depletion of the oil phase is more complete than with a mixing and separating system that does not prevent the exclusion of air/gas introduction in accordance with the invention.

The apparatus may also be utilized, moreover, in a downstream step for the separation of free fatty acids from an oil phase.

Such apparatus of the invention are designed for performing individual method steps of the method of the invention, which is described below.

1. Preparatory Steps

A first step A sees the provision of raw oil—that is, of the organic oil to be processed.

Principal products obtained from the oil may be used for example, though not exclusively, as fuels or else as edible oils. As and when required, the products of value recovered may also be esterified in a processing step to obtain biodiesel.

For obtaining raw oil, preparatory steps may be performed. Starting from plant seeds, these can be prepared, hulled for example, and subsequently deoiled. Deoiling may be accomplished for example by means of a pressing operation. Hot-pressing and cold-pressing methods are known for the recovery of vegetable oil. Extraction processes as well can be employed, such as hexane extraction, for example.

The term "raw oil" or "organic oil" as used herein embraces compositions of biological origin which can be obtained, therefore, from plants, algae, animals and/or microorganisms and which have a water content of <10% and include a total content of lipophilic substances, including monoacylglycerides, diacylglycerides and/or triacylglycerides, of >70 wt % or >75 wt % or >80 wt % or >85 wt % or >90 wt % or >95 wt %. The lipoid phases, accordingly, may be, for example, extracts of oil-bearing plants and microorganisms, such as seeds of oilseed rape, soybeans, canelina, jatropha, palms, or else of algen and microalgen, and also animal fats and oils.

The raw oil preferably has a water content of <10% and a fraction of alkanes and/or cyclic aromatics and/or mono/di/triglycerides (acylglycerides) of >75%. It is immaterial here whether the lipoid phase is a suspension, emulsion or colloidal liquid.

An organic oil or raw oil may for example be a vegetable oil. However, the raw oil may also be an oil of animal origin. Likewise, the raw oil may be an oil which has already been used, such as frying fat, for example, which has already been utilized and which requires processing for further use, as a fuel, for example. Many other refined oils are conceivable which can be processed in the context of the present invention.

Where the raw oil is an extract or comprises extraction phases of lipid and lipoid substances from a prior removal or extraction procedure, the raw oil may also consist, in a fraction of >50%, of organic solvents or hydrocarbon compounds.

In the context of the present invention, fats and oils are classed as lipids, whereas the group of the lipoids embraces all other compounds from the class of waxes, carotenoids, glycolipids, phosphatides, prostaglandins, etc. (Definition according to Beyer, Walter, "Lehrbuch der Organischen Chemie" 21st edition, S. Hirzel Verlag, 1988—p. 248)

As natural constituents of virtually all cells in living plant and animal entities, phospholipids, glycolipids, glycoglycerolipids, and glycosphingolipids as well are unavoidably present likewise in oils or fats (such as vegetable oils, for example) obtained from these entities or plants. The fraction in which this is actually the case is dependent not only on the tissue from which extraction has taken place but also on the extraction method. Table 1 summarizes certain classes of substance which occur in oils and/or fats, and have been obtained from various crop plants. Here it is already apparent that in general the neutral lipids make up the major fraction of the oils or fats, but that the fraction of phospholipids and glycolipids/glycoglycerolipids/glycosphingolipids is extremely variable. For instance, the fraction of glycolipids, glycoglycerolipids, and glycosphingolipids ranges from 0.2% in coconut oil, through about 2% in borage oil and 6.3-7% in rice germ oil through to 19.4% in oil from avocado stones.

TABLE 1 content of lipids without ionic groups (NL), phospholipids (PL), and glycolipids together with glycoglycerolipids and glycosphingolipids (GL) in the seeds (S) and, respectively, the oils obtained therefrom, for selected plants. The content of PL and also GL is reported in percentage of the total oil. In the case of seeds, there is in some cases an additional note of the level of the percentage oil fraction (total) in comparison to the seed mass.

| Source | Oil | S | Total | NL | PL | GL |
|---|---|---|---|---|---|---|
| Soybean: *Glycine soya* | X | | | 88 | 10 | 2 |
| Palm: *Elaieis guineensis* | X | | | 96 | 2.4 | 1.4 |
| Rice germ: *Oryza sativa* | | X | 21.9-23.0 | 88.1-89.2 | 4.5-4.9 | 6.3-7.0 |
| Corn *Zea mays* | X | | | 96.8-97.5 | 0.8-0.95 | 1.5-1.66 |
| Oilseed rape | | X | | 95.8 | 3.2 | 0.9 |
| *Brassica napus* | | | | 95.5 | 3.6 | 0.9 |
| Oilseed rape-Variety "Golden": *Brassica* | | X | 34.8 | 98.8 | 3.0 | |
| Oilseed rape-Variety "Zero Eruca": *Brassica* | | X | 35.9 | 98.1 | 1.8 | |
| Sunflower seeds: *Helianthus annuus* | | X | | | <4 | |
| *Jatropha*: *Jatropha curcus* | | X | 32 | 97.6 | 1.45 | 0.95 |
| Coconut *Cocos nucifera* | X | | | 93.6-98.2 | 0.03-0.4 | 0.2-0.35 |
| Cocoa butter | X | | | 98.75 | 0.037 | 0.89 |
| Dyer's saffron: *Carthamus tinctorius* | X | | | 94 | 1.2 | 4.5 |
| Borage: *Borago officinalis* | | X | 34.0 | 95.7 | 2.3 | 2.0 |
| Crambie: *Crambe abyssinica* | | X | 32.2 | 98.5 | 1.1 | |
| Crambie: *Crambe abyssinica* | X | | 75 | 88.6 | 11 | — |
| Black cumine: *Nigella sativa* | X | | | 97.2 | 0.3 | 2.18 |
| Coriander oil: *Coriandrum sativum* | X | | | 96.0 | 0.85 | 2.39 |
| Niger seed: *Guizotia abyssinica* | X | | | 97.0 | 0.28 | 1.90 |
| Nalta jute: *Corchorus olitorius* | X | | | 93.2 | 1.9 | 3.7 |
| *Hibiscus*: *Hibiscus sabdariffa* | X | | | 94.1 | 2.1 | 2.6 |
| Avocado: *Persea americana* | | X | 10.8 | 60.2 | 20.4 | 19.4 |
| White star apple: *Chrysophyllum albidum* | | X | 7.7 | 54.6 | 23.4 | 22 |
| Bitter melon: *Mormodica charantia* | X | | | 86.8-91.1 | 3.22-4.62 | 4.37-7.43 |
| Sesame: *Sesamum indicum* | X | | 42.5-46.2 | 91.7-93.3 | 0.08-0.1 | 5.6-5.8 |
| Mexican prickly poppy: *Argemone mexicana* | X | | 35 | 92.1-92.3 | 1.5-1.7 | 5.5-5.8 |
| Shiso: *Perilla frutescens* | | X | 38.6-47.8 | 91.2-93.9 | 2.0-3.0 | 3.5-5.8 |
| Mango: *Mangifera indica* | | X | 7.1-10 | 58.5-96.8 | 0.11-0.8 | 0.6-1.2 |
| Blue lupin: *Lupinus angustifolius* | | X | 8.6 | 76.3 | 14.9 | 3.5 |
| *Capsicum*: | | X | 37.5 | 82 | 11.9 | 6.1 |
| *Capsicum annuum* | | | 26.4 | 82 | 13.2 | 4.8 |
| Guinea pepper: | | X | | 67.72 | 13.68 | 3.75 |
| *Atremomum melequeta* | | | | 50.0 | 10.12 | 2.38 |

The raw oils in the sense of the definition used herein include, among others, acai oil, acrocomia oil, almond oil, babassu oil, blackcurrant seed oil, borage seed oil, rapeseed oil, cashew oil, castor oil, coconut oil, coriander oil, corn oil, cottonseed oil, crambe oil, linseed oil, grape seed oil, hazelnut oil, other nut oils, hemp seed oil, jatropha oil, jojoba oil, macadamia nut oil, mango kernel oil, lady's smock oil, mustard oil, neat's foot oil, olive oil, palm oil, palm kernel oil, palmolein oil, peanut oil, pecan oil, pine kernel oil, pistachio oil, poppy oil, rice germ oil, safflower oil, camellia oil, sesame oil, shea butter oil, soybean oil, sunflower oil, tall oil, tsubaki oil, walnut oil, grades of "natural" oils with fatty acid compositions that are modified by way of genetically modified organisms (GMOs) or traditional breeding, *Neochloris oleoabundans* oil, *Scenedesmus dimorphus* oil, *Euglena gracilis* oil, *Phaeodactylum tricornutum* oil, *Pleurochrysis carterae* oil, *Prymnesium parvum* oil, *Tetraselmis chui* oil, *Tetraselmis suecica* oil, *Isochrysis galbana* oil, *Nannochloropsis salina* oil, *Botryococcus braunii* oil, *Dunaliella tertiolecta* oil, *Nannochloris* oil, *Spirulina* oil, *Chlorophyceae* oil, *Bacilliarophyta* oil, a mixture of the preceding oils, and also animal oils (especially marine animal oils) and biodiesel.

In addition to the aforementioned substances, the fraction of so-called free fatty acids and sterylglycosides in the aforesaid oils and fats is also not suitable. The aim is to obtain these substances as far as possible free from concomitants, and with high selectivity.

Deoiling produces a raw oil phase and a solid phase. The solids of the solid phase can be processed further in order to isolate or accumulate, for example, feedstuffs, fiber materials, proteins, polyphenols or other substances of value.

In oil processing, concomitants, which lower the quality of the principal product, are separated from the principal product. These concomitant products may likewise be purified and sold as products of value.

These products of value include among others, glycerol, sterylglycosides, the free fatty acids, phospholipids, tocopherol, and other substances. In the raw oil they are present preferably in an amount of less than 400 ppm, preferably of less than 100 ppm.

Degumming

In a further step of oil processing, so-called degumming takes place. In this operation, phospholipids are removed. These are phosphorus-containing organic substances which have the properties of a fat. The phospholipids are differentiated into non-hydratable phospholipids (NHP) and hydratable phospholipids (HB). Examples of hydratable phospholipids are phosphatidylinositol or salts thereof, phosphatidylcholine. Examples of non-hydratable phospholipids are phosphatidylethanolamine and phosphatidic acid or salts thereof. Examples of typical cations of the phospholipids are sodium, potassium, calcium, etc.

2. Removal of Hydratable Phospholipids

In a second step B, first of all, hydratable phospholipids and/or non-hydratable phospholipids, which, however, can easily be converted into a hydratable form, are removed.

For the degumming, water is added to the raw oil, and phospholipids, where they are hydratable, are hydrated. These phospholipids are obtained as sludge and can be separated centrifugally from the oil.

Non-hydratable phospholipids can be destroyed by heating, by addition of particular adsorbents, by filtration and/or by addition of an acid, as a complex, and thereby converted into a hydratable form. The addition of acid is called acid degumming, whereas the exclusive addition of water is known as water degumming. After the degumming, a degummed oil fraction is obtained which, however, still has a residual fraction of phospholipids, especially non-hydratable phospholipids (see section 3.1).

It has been found that acid degumming leads to substantially better results of the degumming stage.

For the acid degumming it is possible with advantage to use an acidic aqueous phase which contains, for example, citric acid, acetic acid, formic acid and/or oxalic acid. Alternatively, though less preferably, it is possible to use hydrochloric acid, sulfuric acid, nitric acid and/or phosphoric acid.

Figure 6:
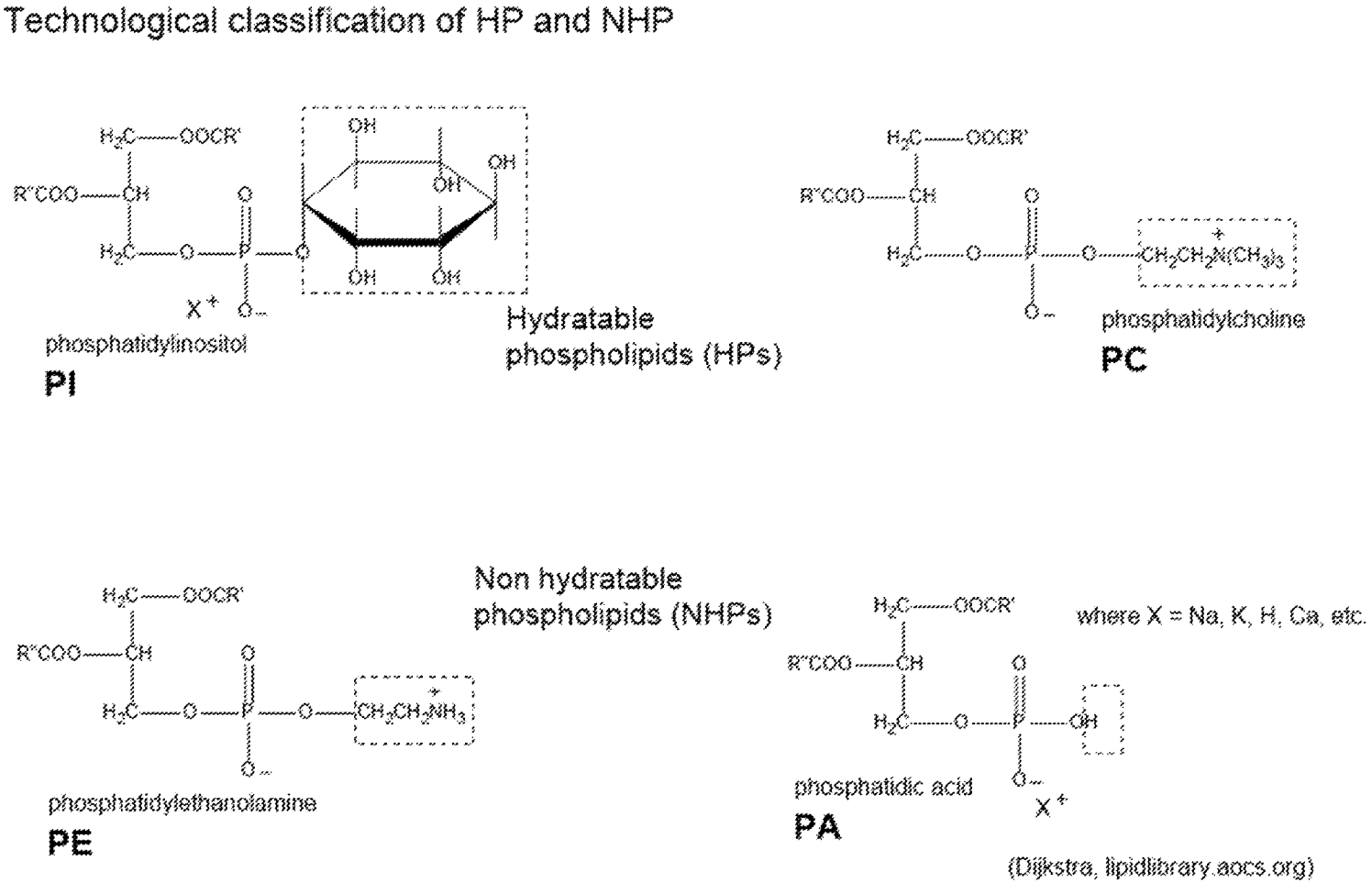
FIG. 6: shows the technological classification of phospholipids in accordance with the definition in the patent.

FIG. 6 shows again, illustratively and by way of example, the classification of the phospholipids into non-hydratable and hydratable phospholipids (NHPs and HPs). Here, in the acidic range, PE can easily be converted into a hydratable form by protonating the amino group as shown in the figure.

3.1 Removal of Residual Non-Hydratable Phospholipids, Incl. Lipoid Removal

In a third step III of the oil processing, sodium hydrogencarbonate is added. It has emerged, surprisingly, that on addition of sodium hydrogencarbonate, there is additional separation of remaining phospholipids, particularly of non-hydratable phospholipids, particularly phosphatidic acid compounds, such as dissolved salts, for example.

Addition of sodium hydrogencarbonate is also accompanied by separation of a fraction of sterylglycosides, which are removed from the degummed oil fraction. Moreover, the fraction of calcium ions, magnesium ions, and, when present, iron ions as well is greatly reduced, since the addition of sodium ions causes these ions to be displaced in the form of sodium hydrogencarbonate. At the same time the free fatty acids remain almost entirely in the oil phase.

The term "fatty acids" is used herein synonymously with the term "free fatty acids". The addition of "free" is intended to make it clear that these are not bound fatty acids, since in the nonpolar oil phase the predominant fraction of the constituents contains bound fatty acids, in the form for example of triacylglycerides, diacylglycerides or monoacylglycerides. Fatty acids are aliphatic monocarboxylic acids having at least 8 carbon atoms.

The term "fatty acids" as used herein refers to free fatty acids (also abbreviated to FFAs), i.e., fatty acids which are present in free form and not bound glyceridically (i.e., to glycerol) or glycosidically (i.e., to sugar residues).

The term "fatty acids" embraces preferably the following compounds: hexanoic acid, octanoic acid, decanoic acid, dodecanoic acid, tetradecanoic acid, hexadecanoic acid, heptadecanoic acid, octadecanoic acid, eicosanoic acid, docosanoic acid, tetracosanoic acid, cis-9-tetradecenoic acid, cis-9-hexadecenoic acid, cis-6-octadecenoic acid, cis-9-octadecenoic acid, cis-11-octadecenoic acid, cis-9-eicosenoic acid, cis-11-eicosenoic acid, cis-13-docosenoic acid, cis-15-tetracosenoic acid, t9-octadecenoic acid, t11-octadecenoic acid, t3-hexadecenoic acid, 9,12-octadecadienoic acid, 6,9,12-octadecatrienoic acid, 8,11,14-eicosatrienoic acid, 5,8,11,14-eicosatetraenoic acid, 7,10,13,16-docosatetraenoic acid, 4,7,10,13,16-docosapentaenoic acid, 9,12,15-octadecatrienoic acid, 6,9,12,15-octadecatetraenoic acid, 8,11,14,17-eicosatetraenoic acid, 5,8,11,14,17-eicosapentaenoic acid, 7,10,13,16,19-docosapentaenoic acid, 4,7,10,13,16,19-docosahexaenoic acid, 5,8,11-eicosatrienoic acid, 9c11t13t-eleostearic acid, 8t10t12c-calendulic acid, 9c11t13c-catalpic acid, 4,7,9,11,13,16,19-docosaheptadecanoic acid, taxoleic acid, pinolenoic acid, sciadonic acid, 6-octadecynoic acid, t11-octadecen-9-ynoic acid, 9-octadecynoic acid, 6-octadecen-9-ynoic acid, t10-heptadecen-8-ynoic acid, 9-octadecen-12-ynoic acid, t7,t11-octadecadien-9-ynoic acid, t8,t10-octadecadien-12-ynoic acid, 5,8,11,14-eicosatetraynoic acid, retinoic acid, isopalmitic acid, pristanic acid, phytac acid, 11,12-methylene-octadecanoic acid, 9,10-methylene-hexadecanoic acid, coronaric acid, (R,S)-lipoic acid, (S)-lipoic acid, (R)-lipoic acid, 6,8(methylsulfanyl)octanoic acid, 4,6-bis(methyl sulfanyl)hexanoic acid, 2,4-bis(methyl sulfanyl)butanoic acid, 1,2-dithiolanecarboxyic acid, (R,S)-6,8-dithianoctanoic acid, (S)-6,8-dithianoctanoic acid, tariric acid, santalbinic acid, stearolic acid, 6,9-octadecenynoic acid, pyrulic acid, crepenic acid, heisteric acid, t8,t10-octadecadien-12-ynoic acid, ETYA, cerebronic acid, hydroxynervonic acid, ricinoleic acid, lesquerolinic acid, brassylinic acid, and thapsic acid. Free fatty acids may be utilized, for example, as a pure fraction in edible fats, such as in margarines, or in paints and inks or else, optionally, as biodiesel fuels as well.

This leaves an oil phase in which the phospholipid content and also the fraction of alkaline earth metal compounds, including chlorophyll, for example, is already significantly lowered, but in which the free fatty acids are still present almost completely. The attainable fraction of alkaline earth metal and P may be lowered to a level of down to less than 1 ppm. In practice it has been indicated to leave a P content of around about 5 ppm, since a final reduction in the P content can take place in step 3, together with the neutralization of the FFAs. Nevertheless, the content of P in the soap fraction obtained in step 4 is very low (3-5 ppm of P from the oil are transferred into the soap fraction).

4.1 Neutralization after Step 3.1

As is known, free fatty acids can easily enter into oxidative forms of bonding. In order to ensure the keeping qualities of refined oil and oil derivatives, therefore, these free fatty acids ought to be removed from the processed oil phase. This is done in a fourth step D, in which the processed oil phase is admixed with an alkaline agent. This agent is preferably an alkali metal hydroxide solution, in other words a sodium hydroxide or potassium hydroxide solution, with the use of sodium hydroxide solution having proved particularly efficient and cost-effective.

This hydroxide solution removes the free fatty acids as concomitants from the oil phase. The free fatty acids are hydrolyzed and can be recovered in very high purity through the prior removal of phospholipids and also of unwanted cations (alkaline earth metal ions and iron ions).

Subsequently it is possible for the free fatty acids to be recovered from the soaps by means of soap cleaving, by addition of acid, for example.

This stepwise processing of the raw oil allows a highly pure principal product to be produced, and a fraction of hydrolyzed free fatty acids with a very high degree of purity to be obtained.

Here, therefore, by means of the fourth step, through addition of an alkaline agent, a fraction of a comparatively pure fatty acid is separated off as soap. By means of this step, the phosphorus content of the processed oil phase can be lowered to a level of below 3 ppm, preferably even below 1 ppm, since fractions of NHPs are removed more easily with the soap after step 3.

5. Bleaching & Deodorizing

Finally, there is a further refining of the principal product, namely of the oils and fats, by a bleaching and/or a deodorizing operation.

In the case of bleaching, bleaching earth can be used predominantly as the agent, being able to be used more efficiently in the present method. It is also possible for the bleaching earth to be added simultaneously with the sodium hydrogencarbonate or sodium acetate.

The deodorizing may take place, for example, by steam distillation in what is called a deodorizer. Here, for example, unwanted odorants can be removed from the oil.

It is also possible, optionally, for further steps to take place in the process of refining the oil and/or fat, before or after the bleaching and/or deodorizing. Such steps include, for example, oil polishing and/or drying under reduced pressure in order to remove water fractions.

3.2 Sterylglycoside Recovery

In the third step C of oil processing, it is also possible optionally for sodium acetate to be added instead of the sodium hydrogencarbonate. It has been found, surprisingly, that the addition of sodium acetate is accompanied by additional accumulation of sterylglycosides in the aqueous phase, these glycosides being removed from the degummed oil fraction. At the same time, residual phospholipids, free fatty acids, and alkaline earth metal compounds, such as chlorophyll, for example, remain predominantly or almost completely in the oil phase.

The sterylglycosides are sterols which are linked glycosidically via a hydroxyl group to at least one saccharide residue. Sterylglycosides occur in plants, animals, fungi, and also in some bacteria. In animals, for example, there is the cholesterol glucuronide, in which a cholesterol residue is linked to a glucuronic acid residue. In plants, the sterol residue is preferably campesterol, stigmasterol, sitosterol, brassicasterol or dihydrositosterol, and the saccharide residue is preferably glucose, galactose, mannose, glucuronic acid, xylose, rhamnose or arabinose. In the case of plant sterylglycosides, the saccharide residue is joined to the sterol via the hydroxyl group at C3 of the A ring of the sterol. Linked to this first saccharide residue there may be further saccharide residues, via a β-1,4-glycosidic bond or a β-1,6-glycosidic bond. There are also acylated sterylglycosides (ASGs), in which a saccharide residue is esterified at its hydroxyl group in position 6 with a fatty acid. In many plants, acylated sterylglycosides have been detected at up to 0.125 wt % in virtually all parts of the plant. The fraction of nonacylated and acylated sterylglycosides is particularly high in palm oil and soybean oil. In the production of biodiesel, a high fraction of sterylglycosides is being discussed in connection with an impaired filterability. An oil phase is left in which the fraction of sterylglycoside is already significantly reduced, this facilitating further processing. A deposition phase may take place here through a further step, by addition of an alkaline agent.

The sterylglycoside fraction in the water phase is relatively high, i.e., at least above 60 wt %, preferably above 80 wt %, as compared with the sterylglycoside fraction in the oil phase.

The sterylglycosides obtained can be utilized in cosmetic products and/or pharmaceutical products.

4.2 Neutralization after Step 3.2

In a fourth step D, in which an alkaline agent is added to the processed oil phase, the system is split into nonpolar oil phase and polar aqueous soap phase. The agent here is preferably an alkali metal hydroxide solution, in other words a sodium hydroxide or potassium hydroxide solution, with the use of sodium hydroxide solution having proven particularly preferred in this case as well.

This hydroxide solution removes the free fatty acids, and now also the remaining phospholipids and alkaline earth metal species, including chlorophyll, for instance, as concomitants in an aqueous phase, from the oil phase. These free fatty acids are hydrolyzed and can be recovered optionally by subsequent soap cleaving.

For the removal of the aforementioned substances, particularly the phospholipids and/or the free fatty acids, the above removal of sterylglycosides has proven particularly advantageous.

Subsequently, as described above, there is further refining of the principal product, i.e., of the oils and fats, by a bleaching and/or a deodorizing operation.

The intention in the text below is to discuss the method of the invention in more depth, by reference to two examples and with comparison with a comparative example.

Example 1

Raw oil (FFA content 0.48 wt %, $H_2O$ content 0.05 wt %, iron content 1.13 ppm, phosphorus content 80.42 ppm, magnesium content 8.47 ppm, calcium content 45.10 ppm) is introduced as pressed oil from rapeseed into the feed tank (feed tank 1).

The raw oil in feed tank 1 is subsequently heated to 85° C. and then admixed with 0.1 wt % of dilute citric acid (33% strength by weight, at room temperature) and stirred thoroughly for 30 seconds and thereafter at around 100 to 150 rpm for 10 minutes. This is followed by addition of 0.6 wt % of water.

The mixture of oil and dilute citric acid is then pumped into the separator, and then the aqueous phase B is separated from the oily phase A with an output of 200 l/h. The aqueous phase A is collected and is stored pending further use. The oily phase A is transferred for further processing into a further feed tank (feed tank 2). The oily phase A is subsequently analyzed (FFA content 0.48 wt %, $H_2O$ content 0.23 wt %, iron content 0.34 ppm, phosphorus content 26.1 ppm, magnesium content 2.32 ppm, calcium content 9.04 ppm).

The resulting oily phase A is brought to an operating temperature of 45° and 8 wt % strength sodium hydrogencarbonate solution is added in a volume sufficient to give a theoretical degree of neutralization of the free fatty acids of 90%. A sufficient volume of sodium hydrogencarbonate can be selected such that more than 0.1 wt % of $NaHCO_3$, based on the weight of oil phase used, e.g., 0.3 wt % of $NaHCO_3$, is added. Addition need not necessarily take place in solution form, but may also take place in powder form. After that, water can be added separately. Lastly, stirring takes place using an Ystral mixer for 30 seconds, intensively but without introduction of air, i.e., without introduction of gas, followed by stirring for 10 minutes normally but still without introduction of air, i.e., without introduction of gas. The resulting mixture is subsequently pumped into the separator and the aqueous phase B is separated thus from the oily phase A with an output of 200 l/h.

The aqueous phase B is collected. Sterylglycosides were detected therein by TLC. For further processing, the oily phase A is transferred back into feed tank 1. The oily phase is subsequently analyzed (FFA content 0.32 wt %, $H_2O$ content 0.23 wt %, iron content 0.15 ppm, phosphorus content 5.75 ppm, magnesium content 0.69 ppm, calcium content 3.46 ppm).

Example 2

Raw oil (FFA content 0.43 wt %, $H_2O$ content 0.05 wt %, iron content 0.60 ppm, phosphorus content 52.52 ppm, magnesium content 5.43 ppm, calcium content 31.33 ppm) is introduced as pressed oil from rapeseed into the feed tank (feed tank 1).

The raw oil in feed tank 1 is subsequently heated to 85° C. and then admixed with 0.1 wt % of citric acid (33% strength by weight, at room temperature) and stirred thoroughly for 30 seconds and thereafter at around 100 to 150 rpm for 10 minutes. This is followed by addition of 0.6 wt % of water.

The mixture of raw oil and dilute citric acid is then pumped into the separator, and then the aqueous phase B is separated from the oily phase A with an output of 200 l/h. The aqueous phase A is collected and is stored pending further use. The oily phase A is transferred for further processing into a further feed tank (feed tank 2). The oily phase A is subsequently analyzed (FFA content 0.43 wt %, $H_2O$ content 0.26 wt %, iron content 0.17 ppm, phosphorus content 12.49 ppm, magnesium content 0.40 ppm, calcium content 1.85 ppm).

The resulting oily phase A is brought to an operating temperature of 45° and 8% strength sodium acetate solution is added in a volume sufficient to give a degree of neutralization of the free fatty acids of 90%. Subsequently, using an Ystral mixer, stirring takes place intensively for 30 seconds and preferably without introduction of gas, and thereafter normally for 10 minutes and preferably without introduction of gas. The resulting mixture is subsequently pumped into the separator and the aqueous phase B is separated thus from the oily phase A with an output of 200 l/h.

In the aqueous phase B, sterylglycosides were detected by TLC. For further processing, the oily phase A is transferred back into feed tank 1. The oily phase A is analyzed (FFA content 0.43 wt %, $H_2O$ content 0.24 wt %, iron content 0.09 ppm, phosphorus content 5.79 ppm, magnesium content 0.25 ppm, calcium content 0.89 ppm).

Comparative Example with Sodium Carbonate:

Raw oil (FFA content 0.54 wt %, $H_2O$ content 0.05 wt %, iron content 0.53 ppm, phosphorus content 78.32 ppm, magnesium content 5.70 ppm, calcium content 33.04 ppm) is introduced as pressed oil from rapeseed into the feed tank (feed tank 1).

The raw oil in feed tank 1 is subsequently heated to about 85° C. and then admixed with 0.1 wt % of citric acid (33% strength by weight, at room temperature) and stirred thoroughly for 30 seconds and thereafter at around 100 to 150 rpm for 10 minutes. This is followed by addition of 0.6 wt % of water.

The mixture of raw oil and dilute citric acid is then pumped into the separator, and then the aqueous phase B is separated from the oily phase A with an output of 200 l/h. The aqueous phase A is collected and is stored pending further use. The oily phase B is transferred for further processing into a further feed tank (feed tank 2). The oily phase A is subsequently analyzed (FFA content 0.48 wt %, $H_2O$ content 0.53 wt %, iron content 0.15 ppm, phosphorus content 16.57 ppm, magnesium content 0.28 ppm, calcium content 1.78 ppm).

The resulting oily phase A is brought to an operating temperature of 40-45° C. and 8% strength sodium acetate solution is added in a volume sufficient to give a theoretical degree of neutralization of the free fatty acids of 90%. Subsequently, using an Ystral mixer, stirring takes place intensively for 30 seconds and preferably without introduction of gas, and thereafter normally for 10 minutes and preferably without introduction of gas. The resulting mixture is subsequently pumped into the separator and the aqueous phase B is separated thus from the oily phase A with an output of 200 l/h.

In the aqueous phase B, sterylglycosides were detected by TLC. For further processing, the oily phase A is transferred back into feed tank 1. The oily phase A is analyzed (FFA content 0.25 wt %, $H_2O$ content 0.49 wt %, iron content 0.15 ppm, phosphorus content 2.21 ppm, magnesium content 0.07 ppm, calcium content 0.32 ppm).

Examples 1 and 2 can be processed subsequently by addition of a sufficient amount of 12% strength NaOH solution in what is called an oil polishing process. This allows the oil phase to be separated from hydrolyzed free fatty acids.

This can be followed by bleaching and deodorizing.

Figure 4:
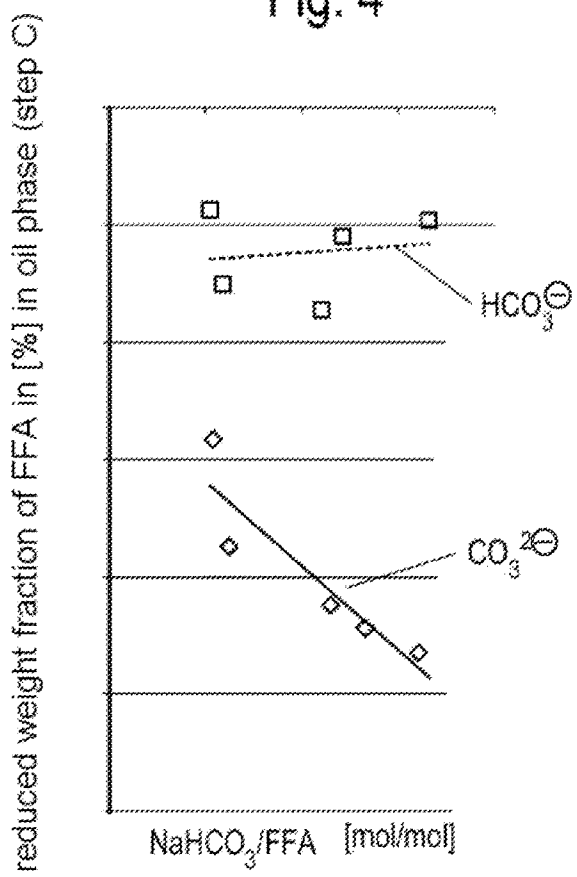
FIG. 4: shows a profile of the percentage decrease in weight fraction of free fatty acids in the oil phase following addition of sodium hydrogencarbonate solution in comparison to the addition of a sodium carbonate solution.
Figure 3:
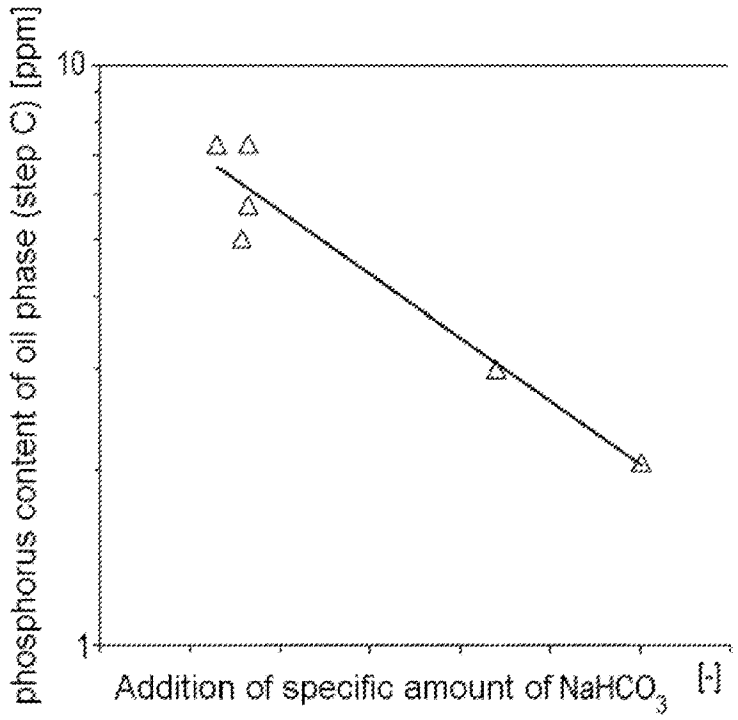
FIG. 3: shows a concentration profile found for the phosphorus content of the oil phase following addition of sodium hydrogencarbonate solution.

Using data determined experimentally, FIG. 3 shows that on addition of a sodium hydrogencarbonate solution in step C, the phosphorus content of the oil phase is reduced. This reduced phosphorus content is accompanied by a reduction in phospholipids in the oil phase. FIG. 4 also shows that the fraction of free fatty acids is not reduced when sodium hydrogencarbonate is added. In comparison, it is evident from FIG. 4 that on addition of sodium carbonate, there is a reduction in fatty acids in the oil phase.

In analogy to the phosphorus content, a reduction in—among others—calcium ions, magnesium ions, and iron ions in the oil was also found on addition of sodium hydrogencarbonate. At the same time, the aforementioned ions removed were detectable in the water phase.

Comparative Example with Sodium Chloride:

Raw oil A1 was treated at 85° C. with aqueous citric acid solution (33% strength, addition: 1000 ppm) and mixed for 30 seconds with a shearing head mixer. After a reaction time of 10 minutes, a sample was taken and the oil phase A2 was measured.

The oil phase A2 thus treated was admixed with 1 wt % of sodium chloride and 3 wt % of distilled water, and mixed for 30 seconds at 60° C. with a shearing head mixer. After a reaction time of 10 minutes, a sample was taken and the oil phase A3 was measured.

The acid-degummed oil phase A2 was admixed with 1 wt % of sodium hydrogencarbonate and 3 wt % of distilled water and mixed for 30 seconds at 60° C. with a shearing head mixer. After a reaction time of 10 minutes, a sample was taken and the oil phase A4 was measured.

The results obtained were as follows:

| Sample name | P mg/kg | Fe mg/kg | Ca mg/kg | Mg mg/kg |
|---|---|---|---|---|
| Oil phase A4 | 1.7 | 0.07 | 1.9 | 0.2 |
| Oil phase A3 | 12.1 | 0.25 | 1.6 | 0.4 |
| Oil phase A2 | 17.3 | 0.18 | 5.8 | 1.2 |
| Oil phase A1 | 58.2 | 0.41 | 41.4 | 6.3 |

As can be seen from the results above, identical treatment of the identical oil phase A2 with sodium hydrogencarbonate and with sodium chloride results in a significant reduction in phospholipids in the case of sodium hydrogencarbonate, by more than 7-fold. Also clearly apparent are significant reductions for Fe, Ca, and Mg, which (apart from Ca) are not identified when sodium chloride is used and pretreatment is identical.

Figure 5A:
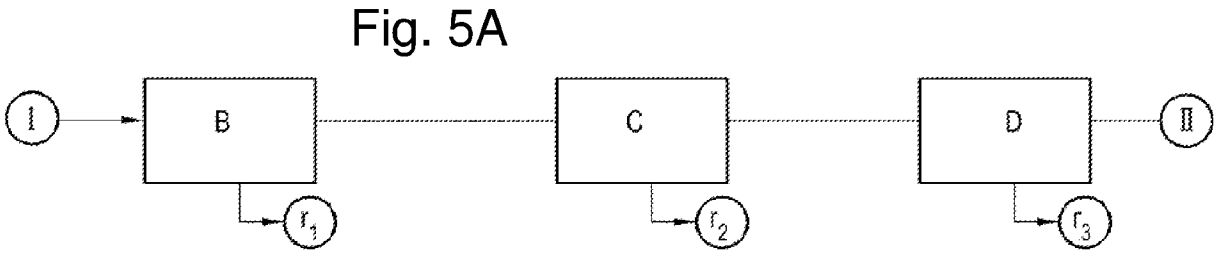
FIGS. 5A and 5B: show on an exemplary basis the adjustment of the phosphorus content obtained by metering of acidic and alkaline agents in method steps B, C, and D.
Figure 5B:
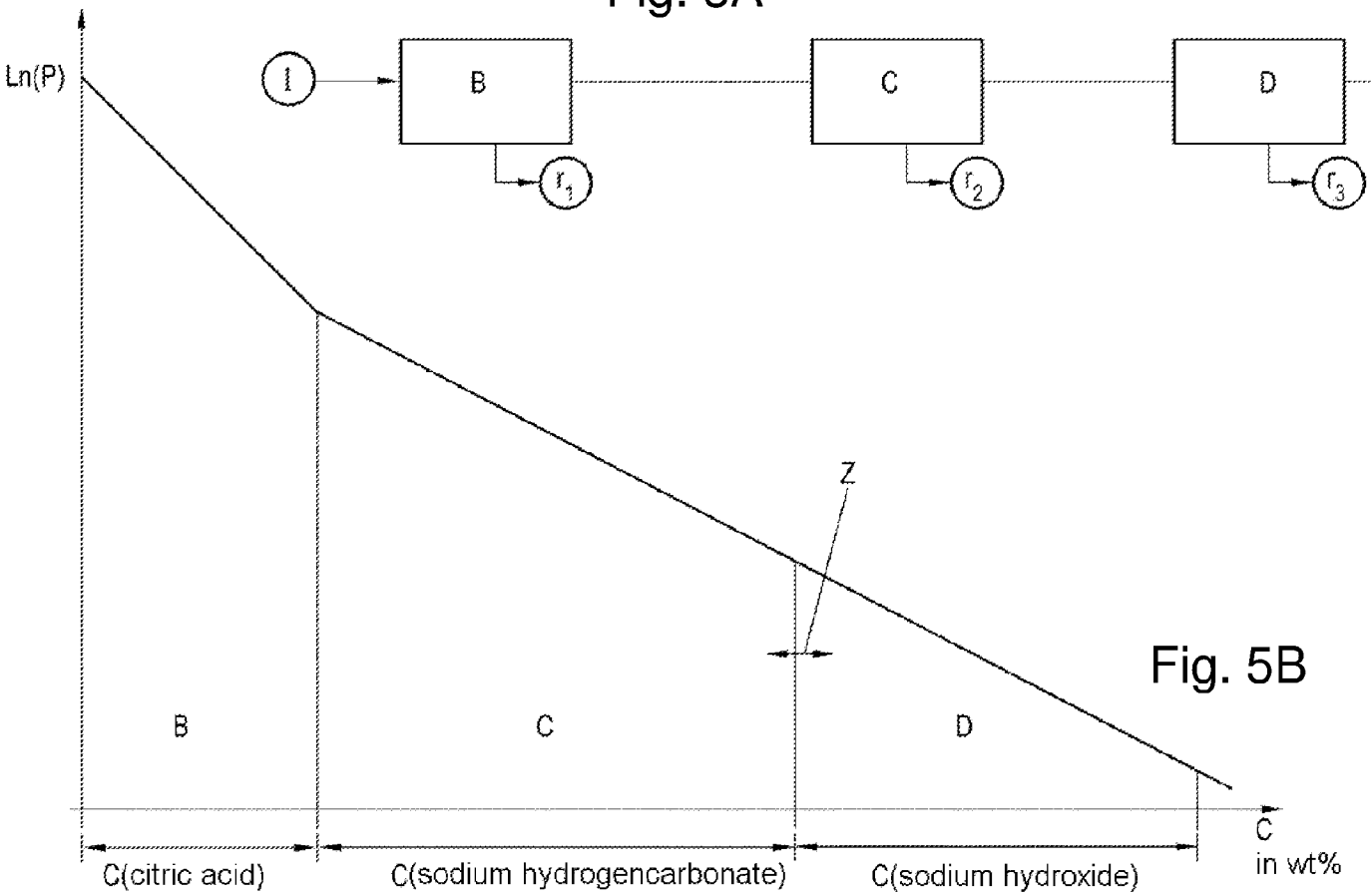

FIG. 5A shows an exemplary sequence of method steps B and C, and also optional method step D. Starting from a raw oil I, first citric acid is added as an aqueous solution. At this point the phosphorus content and hence also the fraction of phospholipids in the oil phase is reduced. The aqueous phase $r_1$ is separated from the oil phase. A fraction of sodium hydrogencarbonate is added in the form of a solution, suspension or powder to the oil phase—in the case of an addition as a powder, there is preferably subsequent addition of water. A further reduction in phospholipids takes place in the oil phase. The aqueous phase $r_2$ is removed from the oil phase. Then, in the optional step D, further phospholipids can be removed. Depending on the metering volume in step C, however, the concentration of phospholipids in the oil phase may be very low, and so need hardly be taken into account anymore relative to the fatty acids. The boundary Z between the two steps can therefore be selected variably. It is also dependent inter alia on the desired target specification for the purity of the FFA phase.

The concentration of free fatty acids can take place through the determination of the acid number of the oil phase after the respective steps. The acid number (AN) is a measure of the amount of free fatty acids (FFAs) in a fat/oil. It corresponds to the amount of potassium hydroxide (KOH) in mg that is required to neutralize the free fatty acids contained in 1 g of fat. To determine the AN, the fat/oil, in solution in a 2:5 mixture of toluene and ethanol, is titrated with 0.1 M KOH against phenolphthalein. The AN can then be calculated as follows:

$$AN = \frac{56.1 \cdot V \cdot N}{E}$$

E initial mass of fat/oil in g
V consumption of sodium hydroxide in ml
N normality of the hydroxide From the acid number it is possible to carry out a direct calculation, via the molar masses of KOH and oleic acid, of the amount of free fatty acids in the fat/oil, in percentage by mass. The calculation is made according to the following equation:

$$\%\ FFA(\text{ml/m}) = AN \cdot \frac{M_{oil}}{M_{KOH} \cdot 10} = AN \cdot 0.503,$$

where
AN=acid number
$M_{oil}$=282.46 g/mol
$M_{KOH}$=56.11 g/mol

For determining the water content of oils, it is usual to follow the method of Karl Fischer. In this method, monomethyl sulfite is oxidized by titration of iodine to form monomethyl sulfate. Iodide is formed, and can be detected visually and electrochemically. The reaction requires additional elemental oxygen, which is supplied only by the water present in the sample. In the present case, the semiautomatic Metrohm KFS-Titrino 720 instrument was used, with analysis of characteristic current/voltage curves recorded during the titration, using platinum electrodes, and corresponding automatic determination of the water content of the sample.

The elements phosphorus, calcium, magnesium, and iron in the oil samples are determined directly and quantitatively by means of Inductively Coupled Plasma emission spectroanalysis (ICP). After being atomized to an aerosol, the sample material is injected into the hot core of an argon plasma. At a temperature of more than 8000 K, the sample material is atomized and at the same time excited. In this form it can be analyzed in the emission spectrum, qualitatively and quantitatively, for trace elements.

The HLB was determined in the aqueous phases and in the oil phases of the respective method steps. Analysis takes place with an Asahipak GF-310 HQ multiple-solvent GPC column. By this means, ionic and nonionic surfactants can be differentiated and ordered according to their HLB.

For the detection of the respective concomitants, such as sterylglycosides, for example, a TLC method (thin-layer chromatography) was employed. The thin-layer chromatography took place using Silica Gel G plates. Separation takes place with a mixture of chloroform/acetone/water (30/60/2). Development was carried out with a naphthylethylenediamine reagent, allowing color representation of sugar residues in the oil concomitants.

The invention claimed is:

1. A method for stepwise processing of an organic oil, the method comprising the steps of:

A providing a raw oil;

B degumming the raw oil by adding water and/or acid to the raw oil and forming at least two phases, an aqueous phase and an oil phase, and separating the aqueous phase enriched is phospholipid from the oil phase;

C adding sodium hydrogencarbonate and/or sodium acetate to the oil phase from step B, and removing alkaline earth metal compounds and/or phospholipids and/or sterylglycosides, in solution or suspension in an aqueous phase, from the oil phase; and D hydrolyzing free fatty acids by adding an alkaline agent to the oil phase from step C and removing these hydrolyzed fatty acids from the oil phase, wherein the hydrolyzed fatty acids have less than 3 wt % of organic impurities.

2. The method as claimed in claim 1, wherein the degumming takes place by addition of an acid selected from one or more of the following acids: citric acid, acetic acid, formic acid, oxalic acid, nitric acid, hydrochloric acid, sulfuric acid and/or phosphoric acid.

3. The method as claimed in claim 1, wherein step B and/or step C take place at a temperature of more than 65° C.

4. The method as claimed in claim 1, wherein step B and/or step C take place at a temperature in the range of 66–95° C.

5. The method as claimed in claim 1, wherein the sodium hydrogencarbonate and/or the sodium acetate are/is added as powder or as suspension to the oil phase in step C.

6. The method as claimed in claim 5, wherein an addition of water is made before or after the addition of the powder.

7. The method as claimed in claim 1, wherein at least 0.1 wt % of sodium hydrogencarbonate and/or sodium acetate is added, based on the total weight of the oil phase in step C.

8. The method as claimed in claim 1, wherein at least 1.0 wt % of water is added, based on the total weight of the oil phase in step C.

9. The method as claimed in claim 1, wherein the addition of sodium hydrogencarbonate according to step C is repeated until the haze of the water phase and/or an alkaline earth metal ion content found in the oil phase and/or a phosphorus content found in the oil phase falls below a specified setpoint value.

10. The method as claimed in claim 1, wherein after the addition of sodium hydrogencarbonate in step C, an aqueous phase is removed which comprises a fraction of free fatty acids corresponding to removal of less than 1% age point of free fatty acids from the oil phase.

11. The method as claimed in claim 1, wherein after the addition of sodium hydrogencarbonate in step C, an aqueous phase is removed which comprises a fraction of free fatty acids corresponding to removal of less than 0.2% age points of free fatty acids from the oil phase.

12. The method as claimed in claim 1, wherein after the addition of sodium acetate in step C, an aqueous phase is removed in which organic constituents are present in solution or suspension, the organic constituents comprising sterylglycosides to an extent of more than 30 wt %.

13. The method as claimed in claim 1, wherein after the addition of sodium acetate in step C, an aqueous phase is removed in which organic constituents are present in solution or suspension, the organic constituents comprising sterylglycosides to an extent of more than 50 wt %.

14. The method as claimed in claim 1, wherein the hydrolyzed fatty acid has less than 1 wt % of organic impurities.

15. The method as claimed in claim 1, wherein following step C or D, the oil phase from step C or D is bleached and/or deodorized.

16. The method as claimed in claim 1, wherein the added alkaline agent in step D is an inorganic alkali metal hydroxide solution.

17. The method as claimed in claim 1, wherein the added alkaline agent in step D is a sodium hydroxide solution.

* * * * *